US006655236B1

(12) United States Patent
Slack et al.

(10) Patent No.: US 6,655,236 B1
(45) Date of Patent: Dec. 2, 2003

(54) HAMMER DEVICE WITH INTERCHANGEABLE HEAD MEMBERS

(76) Inventors: Terry J. Slack, 625 Walsh St., Grass Valley, CA (US) 95945; Tom R. Slack, 625 Walsh St., Grass Valley, CA (US) 95945

( * ) Notice: Subject to any disclaimer, the term of this patent is extended or adjusted under 35 U.S.C. 154(b) by 0 days.

(21) Appl. No.: 10/133,304

(22) Filed: Apr. 26, 2002

(51) Int. Cl.[7] ..... B25D 1/02
(52) U.S. Cl. ..... 81/25; 81/20
(58) Field of Search ..... 81/25, 489, 490, 81/20; 7/143, 146

(56) References Cited

U.S. PATENT DOCUMENTS

| | | | | | |
|---|---|---|---|---|---|
| 974,021 | A | * | 10/1910 | Blake | 81/25 |
| 3,185,146 | A | | 5/1965 | Leopoldi | |
| 3,721,282 | A | | 3/1973 | Hayes et al. | |
| 3,821,973 | A | | 7/1974 | Carmien | |
| 4,183,385 | A | | 1/1980 | Burkybile | |
| 4,291,736 | A | * | 9/1981 | Robertson et al. | 81/24 |
| 4,831,901 | A | * | 5/1989 | Kinne | 81/25 |
| D303,208 | S | | 9/1989 | Chung | |
| 5,119,699 | A | * | 6/1992 | McBride et al. | 81/25 |
| 5,216,939 | A | * | 6/1993 | Swenson | 81/25 |
| 5,526,719 | A | | 6/1996 | Chen | |
| 6,332,376 | B1 | * | 12/2001 | Hurley | 81/23 |
| 6,536,308 | B1 | * | 3/2003 | Thorne et al. | 81/20 |

FOREIGN PATENT DOCUMENTS

| | | | | | |
|---|---|---|---|---|---|
| GB | 1504865 | A | * | 3/1978 | B25D/1/02 |

* cited by examiner

*Primary Examiner*—Lee D. Wilson
*Assistant Examiner*—David B. Thomas

(57) ABSTRACT

A hammer device with interchangeable head members for providing one hammer which can be used to perform multiple functions. The hammer device with interchangeable head members includes a hammer assembly including an elongate handle member and a head member being attached to a top of the handle member; and also includes a plurality of striking members being removably attached to the head member of the hammer assembly; and further includes a plurality of washers being stored in the handle member and being removably mounted to the head member of the hammer assembly.

6 Claims, 1 Drawing Sheet

HAMMER DEVICE WITH INTERCHANGEABLE HEAD MEMBERS

BACKGROUND OF THE INVENTION

1. Field of the Invention

The present invention relates to a multi-functional hammer and more particularly pertains to a new hammer device with interchangeable head members for providing one hammer which can be used to perform multiple functions.

2. Description of the Prior Art

The use of a multi-functional hammer is known in the prior art. More specifically, a multi-functional hammer heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,821,973; U.S. Pat. No. 3,721,282; U.S. Pat. No. 5,216,939; U.S. Pat. No. 3,185,146; U.S. Pat. No. 5,526,719; U.S. Pat. No. 4,183,385; and U.S. Pat. No. Des. 303,208.

While these devices fulfill their respective, particular objectives and requirements, the aforementioned patents do not disclose a new hammer device with interchangeable head members. The inventive device includes a hammer assembly including an elongate handle member and a head member being attached to a top of the handle member; and also includes a plurality of striking members being removably attached to the head member of the hammer assembly; and further includes a plurality of washers being stored in the handle member and being removably mounted to the head member of the hammer assembly.

In these respects, the hammer device with interchangeable head members according to the present invention substantially departs from the conventional concepts and designs of the prior art, and in so doing provides an apparatus primarily developed for the purpose of providing one hammer which can be used to perform multiple functions.

SUMMARY OF THE INVENTION

In view of the foregoing disadvantages inherent in the known types of multi-functional hammer now present in the prior art, the present invention provides a new hammer device with interchangeable head members construction wherein the same can be utilized for providing one hammer which can be used to perform multiple functions.

The general purpose of the present invention, which will be described subsequently in greater detail, is to provide a new hammer device with interchangeable head members which has many of the advantages of the multi-functional hammer mentioned heretofore and many novel features that result in a new hammer device with interchangeable head members which is not anticipated, rendered obvious, suggested, or even implied by any of the prior art multi-functional hammer, either alone or in any combination thereof.

To attain this, the present invention generally comprises a hammer assembly including an elongate handle member and a head member being attached to a top of the handle member; and also includes a plurality of striking members being removably attached to the head member of the hammer assembly; and further includes a plurality of washers being stored in the handle member and being removably mounted to the head member of the hammer assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hammer device with interchangeable head members which has many of the advantages of the multi-functional hammer mentioned heretofore and many novel features that result in a new hammer device with interchangeable head members which is not anticipated, rendered obvious, suggested, or even implied by any of the prior art multi-functional hammer, either alone or in any combination thereof.

It is another object of the present invention to provide a new hammer device with interchangeable head members which may be easily and efficiently manufactured and marketed.

It is a further object of the present invention to provide a new hammer device with interchangeable head members which is of a durable and reliable construction.

An even further object of the present invention is to provide a new hammer device with interchangeable head members which is susceptible of a low cost of manufacture with regard to both materials and labor, and which accordingly is then susceptible of low prices of sale to the consuming public, thereby making such hammer device with interchangeable head members economically available to the buying public.

Still yet another object of the present invention is to provide a new hammer device with interchangeable head members which provides in the apparatuses and methods of the prior art some of the advantages thereof, while simultaneously overcoming some of the disadvantages normally associated therewith.

Still another object of the present invention is to provide a new hammer device with interchangeable head members for providing one hammer which can be used to perform multiple functions.

Yet another object of the present invention is to provide a new hammer device with interchangeable head members which includes a hammer assembly including an elongate handle member and a head member being attached to a top of the handle member; and also includes a plurality of striking members being removably attached to the head member of the hammer assembly; and further includes a plurality of washers being stored in the handle Member and being removably mounted to the head member of the hammer assembly.

Still yet another object of the present invention is to provide a new hammer device with interchangeable head members that is easy and convenient to use.

Even still another object of the present invention is to provide a new hammer device with interchangeable head members that allows the user to do various types of tasks with just one hammer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3:
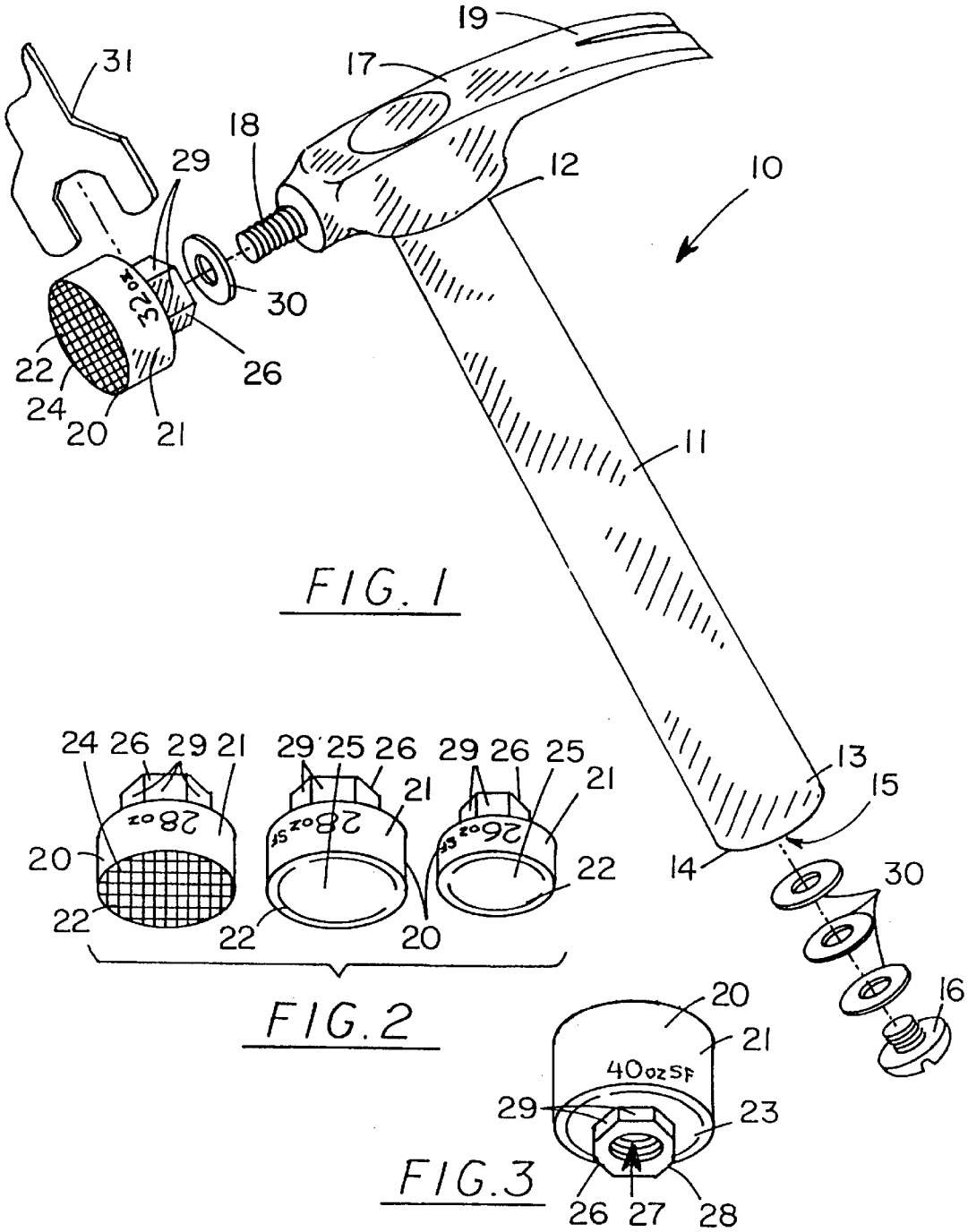
FIG. 1 is a perspective view of a new hammer device with interchangeable head members according to the present invention.
FIG. 2 is a front perspective view of the striking members of the present invention.
FIG. 3 is a rear perspective view of one of the striking members of the present invention.

With reference now to the drawings, and in particular to FIGS. 1 through 3 thereof, a new hammer device with interchangeable head members embodying the principles and concepts of the present invention and generally designated by the reference numeral 10 will be described.

As best illustrated in FIGS. 1 through 3, the hammer device with interchangeable head members 10 generally comprises a hammer assembly including an elongate handle member 11 and a head member 17 being conventionally attached to a top 12 of the handle member 11. The handle member 11 has a storage compartment 14 disposed therein through a bottom 13 thereof. The hammer assembly further includes an endcap member 16 being threaded into an opening 15 of the storage compartment 14 to cover and close the opening 15. The head member 17 includes a threaded stub shaft 18 extending outwardly therefrom and forwardly thereof, and also includes an elongate forked portion 19 extending outwardly therefrom and rearwardly thereof.

A plurality of striking members 20 are removably attached to the head member 17 of the hammer assembly. Each of the striking members 20 includes a weighted disc-shaped body 21 having a front side 22 and a back side 23, and also includes a boss 26 being securely and conventionally disposed upon the back side 23 of the weighted disc-shaped body 21. The striking members 20 also include front sides 22 having waffle-like surfaces 24 and also having flat, smooth surfaces 25. The weighted disc-shaped bodies 21 are uniquely weighted. Each of the bosses 26 has a threaded bore 27 extending therein through an outer end 28 thereof, and also has multiple sides 29 which are adapted to engage a wrench 31 for attaching the striking members 20 upon the head member 17. The bore 27 removably receives the threaded stub shaft 18. The disc-shaped bodies 21 have weights ranging from 26 ounces to 40 ounces. A plurality of washers 30 are stored in the handle member 11 and are removably mounted to the head member 17 of the hammer assembly. The washers 30 are removably disposed in the storage compartment 14 of the handle member 11 and are removably mounted about the threaded stub shaft 18 between the head member 17 and the striking members 20 for securing the striking members 20 upon the threaded stub shaft 18.

In use, the user attaches the striking member 20 desired to accomplish the type of function needed to be performed by threading the selected striking member 20 upon the threaded stub shaft 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A hammer device with interchangeable head members comprising:

a hammer assembly including an elongate handle member and a head member being attached to a top of said handle member;

A plurality of striking members being removably attached to said head member of said hammer assembly;

A plurality of washers being stored in said handle member and being removably mountable to said head member of said hammer assembly;

wherein said head member includes a threaded stub shaft extending outwardly therefrom and forwardly thereof, and also includes an elongate forked portion extending outwardly therefrom and rearwardly thereof;

wherein each of said striking members includes a weighted disc-shaped body having a front side and a back side, and also includes a boss being securely disposed upon said back side of said weighted disc-shaped body; and wherein each of said bosses has a threaded bore extending therein through an outer end thereof, and also has multiple sides which are adapted to engage a wrench for attaching said striking members upon said head member, said bore removably receiving said threaded stub shaft.

2. A hammer device with interchangeable head members as described in claim 1, wherein said handle member has a storage compartment disposed therein through a bottom thereof.

3. A hammer device with interchangeable head members as described in claim 2, wherein said hammer assembly further includes an endcap member being threaded into an opening of said storage compartment to cover and close said opening.

4. A hammer device with interchangeable head members as described in claim 1, wherein said striking members include said front sides having waffle-like surfaces and also having flat, smooth surfaces, said weighted disc-shaped bodies being uniquely weighted.

5. A hammer device with interchangeable head members as described in claim 1, wherein said washers are removably disposed in said storage compartment of said handle member and are removably mounted about said threaded stub shaft between said head member and said striking members for securing said striking members upon said threaded stub shaft.

6. A hammer device with interchangeable head members comprising:

a hammer assembly including an elongate handle member and a head member being attached to a top of said handle member, said handle member having a storage compartment disposed therein through a bottom thereof, said hammer assembly further including an endcap member being threaded into an opening of said storage compartment to cover and close said opening, said head member including a threaded stub shaft extending outwardly therefrom and forwardly thereof, and also including an elongate forked portion extending outwardly therefrom and rearwardly thereof;

a plurality of striking members being removably attached to said head member of said hammer assembly, each of said striking members including a weighted disc-shaped body having a front side and a back side, and also including a boss being securely disposed upon said back side of said weighted disc-shaped body, said striking members including said front sides having waffle-like surfaces and also having flat, smooth surfaces, said weighted disc-shaped bodies being uniquely weighted, each of said bosses having a threaded bore extending therein through an outer end thereof, and also having multiple sides which are adapted to engage a wrench for attaching said striking members upon said head member, said bore removably receiving said threaded stub shaft, said disc-shaped bodies having weights ranging from 26 ounces to 40 ounces; and a plurality of washers being stored in said handle member and being removably mountable to said head member of said hammer assembly, said washers being removably disposed in said storage compartment of said handle member and are removably mounted about said threaded stub shaft between said head member and said striking members for securing said striking members upon said threaded stub shaft.

* * * * *